US005170761A

United States Patent [19]

Kato et al.

[11] Patent Number: 5,170,761

[45] Date of Patent: Dec. 15, 1992

[54] APPARATUS FOR CONTROLLING IDLING REVOLUTION SPEED OF INTERNAL COMBUSTION ENGINE

[75] Inventors: Kinya Kato; Katsuyoshi Fukaya, both of Oobu, Japan

[73] Assignee: Aisan Kogyo Kabushiki Kaisha, Aichi, Japan

[21] Appl. No.: 764,717

[22] Filed: Sep. 24, 1991

[30] Foreign Application Priority Data

Oct. 1, 1990 [JP] Japan ..... 2-264803

[51] Int. Cl.[5] ..... F02D 41/16; F02M 23/06

[52] U.S. Cl. ..... 123/339; 123/585

[58] Field of Search ..... 123/339, 585

[56] References Cited

U.S. PATENT DOCUMENTS 5,065,718 11/1991 Suzuki et al. ..... 123/585 X

FOREIGN PATENT DOCUMENTS 3340060 12/1984 Fed. Rep. of Germany ..... 123/339

129234 8/1982 Japan ..... 123/339

*Primary Examiner*—Tony M. Argenbright

*Attorney, Agent, or Firm*—Koda and Androlia

[57] ABSTRACT

An apparatus for controlling idling revolution speed of an internal combustion engine in which air at an upstream side of a throttle valve of an intake tube of the internal combustion engine is injected nearby a fuel injection valve from an injection port provided in an intake manifold of the internal combustion engine through a bypass passage and a flow rate control device. The flow rate control device is provided with a valve housing and a valve seat retaining member having a cylindrical wall disposed within the valve housing and a valve body which is moved forwardly and backwardly by a stepping motor is seated on a valve seat. A flow space is formed between the valve seat and an outlet port provided in the valve housing for communicating thereof with the injection port. The flow space includes an annular or semi-annular space formed between the valve housing and the valve seat retaining member and provides a long folded air flow passage to remove oil mist and dust from the air flowing toward the injection port.

7 Claims, 4 Drawing Sheets

APPARATUS FOR CONTROLLING IDLING REVOLUTION SPEED OF INTERNAL COMBUSTION ENGINE

BACKGROUND OF THE INVENTION

1. Field of the Invention

The present invention relates to a control apparatus for controlling the idling speed of an internal combustion engine provided with a fuel injection device for controlling a flow rate of air flowing through a bypass air passage by which air is supplied into an intake manifold of said internal combustion engine nearby an injection valve.

2. Description of the Prior Art

An internal combustion engine provided with a fuel injection device, specifically an electronically controlled fuel injection device, is provided with a bypass passage which introduces air in an intake passage of said internal combustion engine from upstream side of a throttle valve and discharges a part of said introduced air into the intake passage at downstream side of the throttle valve and remaining part of said introduced air into an intake manifold through an assist air injection port which is provided nearby a fuel injection valve attached to the intake manifold of said internal combustion engine in order to control idling revolution speed of said internal combustion engine. A flow rate control device is connected to this bypass passage to control the flow rate of air to be supplied to said assist air injection port, referring to, for example, temperature of coolant during idling of said internal combustion engine as a parameter, and improve the efficiency of atomization of fuel to be injected from said fuel injection valve, thus ensuring smooth revolution of said internal combustion engine during idling.

Generally speaking, to prevent discharging of unburned evaporative fuel gas from the internal combustion engine, evaporative fuel gas in a fuel tank and blow-by gas in a crank case are supplied to the upstream side of the throttle valve of the intake passage through a charcoal canister and a blow-by reduction device, respectively. Dust particles in suspension in air includes some fine dust which intrudes into the intake passage through an air filter. Therefore, during operation of the internal combustion engine for many hours, said evaporative fuel gas and blow-by gas (hereinafter referred to as "oil mist") and fine dust enter into said bypass passage and may deposit on said assist air injection port to clog the port and thus cause trouble in controlling idling revolution speed of the internal combustion engine.

SUMMARY OF THE INVENTION

The primary object of the present invention is to provide a control apparatus for controlling idling speed of an internal combustion engine in which a flow rate control device is connected to a bypass passage which bypasses a throttle valve provided in an intake passage of the internal combustion engine, said apparatus being adapted to be able to remove oil mist and dust which may deposit inside said flow rate control device.

Another object of the present invention is to provide a control apparatus capable of depositing oil mist and dust contained in the air introduced into said flow rate control device on an inside wall of an air passage by providing a long folded air passage in said flow rate control device and supplying the air free from oil mist and dust to said intake manifold during idling operation of said internal combustion engine.

Other objects of the present invention will be apparent to those skilled in the art from the following disclosure and the description of preferred embodiment of the present invention.

The present invention relates to a control apparatus for controlling idling speed of an internal combustion engine which is provided with a valve housing having one inlet port and at least one outlet port, a valve seat disposed between said inlet port and outlet port in said valve housing, an actuator attached to said valve housing, a valve body which is driven by said actuator to relatively move to and from an opening of said valve seat along the distance corresponding to a signal applied to said actuator, an air passage communicating said inlet port of said valve housing with upstream side passage of a throttle valve provided in an intake passage of the internal combustion engine, and an air passage communicating said outlet port with an injection port which is opened nearby a fuel injection valve mounted on the intake manifold of said internal combustion engine.

In accordance with the present invention, an annular valve seat retaining member is remountably secured to said valve housing with peripheral edge portions of said valve seat retaining member fixed air-tightly to an inside wall of said valve housing to form therebetween a space communicating with said outlet port, and said valve seat is fixedly retained at the outer peripheral portion thereof to said valve seat retaining member. Said valve seat retaining member is provided with at least an opening thereon at the circumferential position thereof apart from the position opposing to said outlet port to form a folded air passage communicating said valve opening of said valve seat with said outlet port between said inside wall of said valve housing and an outside wall of said valve seat retaining member.

Therefore, in accordance with the present invention, air is introduced into the interior space of said valve housing from said intake passage at the upstream passage of said throttle valve through said inlet port formed on said valve housing by means of the negative pressure produced in the intake manifold of said internal combustion engine during the period when the throttle valve is closed said intake passage and the internal combustion engine is in condition of idling. Then, introduced air is injected through the injection port opened nearby said injection valve into said intake manifold of the internal combustion engine. Air injected from the injection port into the intake manifold improves atomization of fuel injected from said fuel injection valve into the intake manifold.

The flow rate of air introduced into said valve housing is controlled in accordance with the relative positions of the valve opening of said valve seat and said valve body of which position is controlled by means of said actuator in order to increase or decrease quantity of the air supplied from said outlet port of the valve housing to said injection port. Said actuator is controlled by a signal representing the operating condition of the internal combustion engine, for example, temperature of coolant used in said internal combustion engine, to relatively move said valve body to and from the valve opening of said valve seat as far as a distance corresponding to the signal applied and cause the quantity of air in response to the operating condition of the internal combustion engine to be injected into the intake manifold.

The air flow which is controlled in accordance with the relative positions of the opening of said valve seat and the valve body passes through the space formed between the annular valve seat retaining member and the wall of said valve housing from the inside of said annular valve seat retaining member through the opening provided on said valve seat retaining member and flows toward said outlet port. Since the opening formed in said valve seat retaining member is located at a circumferential position which is not opposed to said outlet port formed in the valve housing, said air flow which has passed the opening provided in said valve seat retaining member changes its flowing direction toward the direction along the outer peripheral surface of said valve seat retaining member or the inner wall surface of said valve housing and flows out through said outlet port. Therefore, even if fine dust and oil mist flow with air into said valve housing, these dust and oil mist are deposited on said wall surfaces after the air flow changes its direction and will not clog the injection port formed in the intake manifold of said internal combustion engine.

Since said valve seat retaining member is secured detachably to the valve housing with the peripheral edge portions of the valve seat retaining member fixed air-tightly to the inside wall of the valve housing, said oil mist and dust which have entered into the valve housing will not splash out, and dust and oil mist which have deposited inside the valve housing can be easily removed by dismounting said valve seat retaining member from the valve housing.

In the present invention, preferably, the housing wall of the valve housing on which said outlet port is opened is made to be substantially tubular in construction and said valve seat retaining member is provided with a substantially tubular wall body and a flange radially protruded at one axial end portion of said wall body. Said valve seat retaining member is air-tightly supported at both axial end portions thereof on said housing wall of said valve housing. For accurate measurement and control of the quantity of air to be injected from said injection port, a stepping motor is preferable as said actuator and a casing of said stepping motor is fixed to said valve housing while the center axis of rotation of said stepping motor is aligned with the center axis of the tubular wall body of said valve seat retaining member. The flange of said valve seat retaining member is fixed between the casing of said stepping motor and the valve housing. The valve body is mounted on a shaft which is driven by said stepping motor to move along said center axis of rotation and controls the flow rate of air which passes through the valve seat fixed at its outer periphery to the tubular wall body of said valve seat retaining member, in cooperation with said opening of the valve seat.

A number of projections are preferably provided on one or both of the outer tubular surface of the wall body of said valve seat retaining member and the inner peripheral wall surface of said housing wall of the valve housing located opposing to said outer tubular surface of the wall body to increase the surface areas of these wall surfaces, dust and oil mist contained in the air flow can be efficiently captured.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DESCRIPTION OF THE PREFERRED EMBODIMENT

Figure 1:
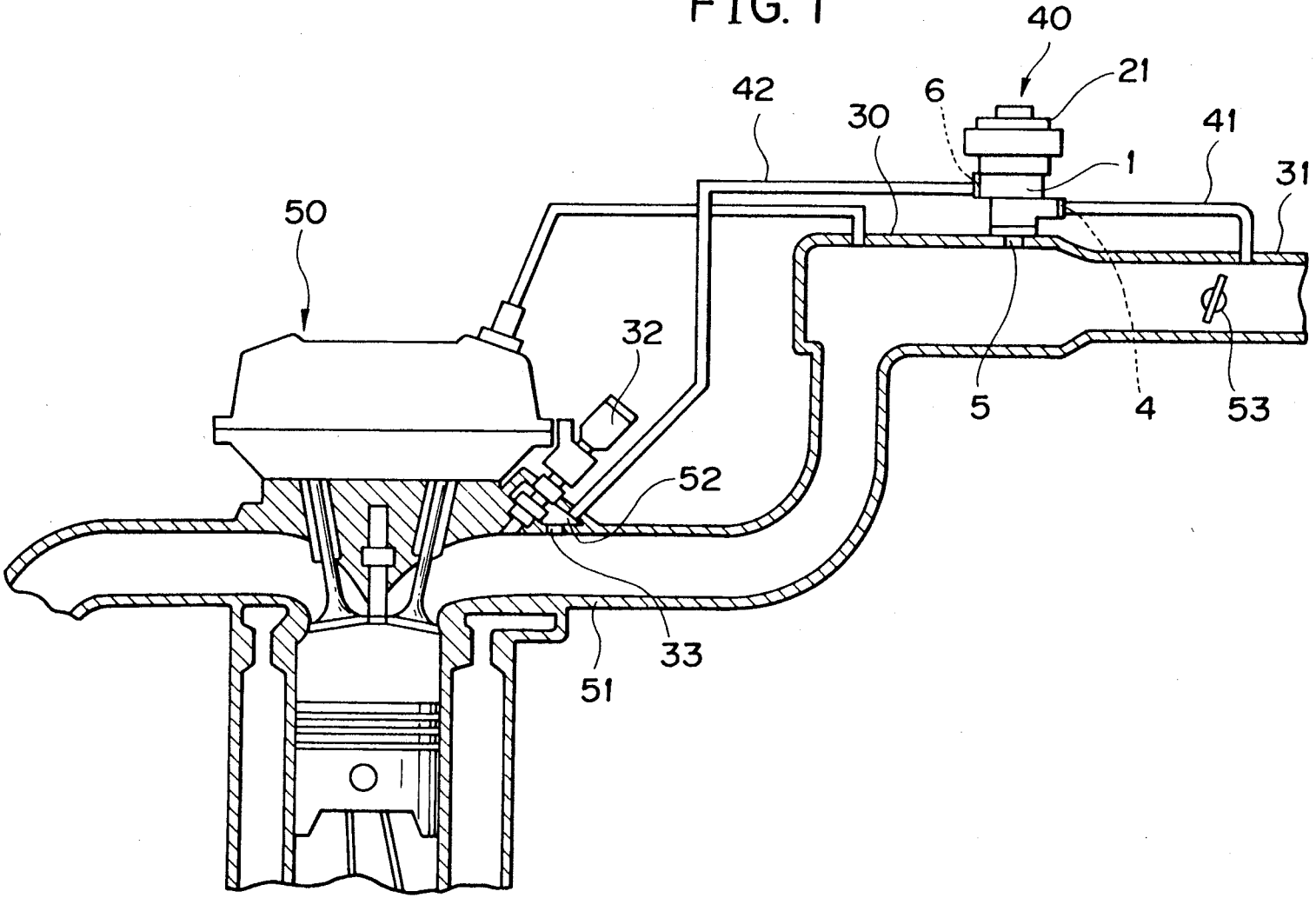
FIG. 1 is a schematic sectional view of an embodiment of the present invention.

Referring to FIG. 1, there is shown a schematic sectional view of an embodiment of control apparatus for controlling idling speed of an internal combustion engine in accordance with the present invention.

A fuel injection valve 32 of an electronically controlled fuel injection device is attached to an intake manifold 51 of the internal combustion engine and an air chamber 52 is formed in said intake manifold 51 to surround said fuel injection valve 32. An injection port 33 which communicates internal air passage of said intake manifold 51 and said air chamber 52 is formed in the intake manifold 51 and assist air is injected from said injection port 33 to improve atomization of fuel injected from said fuel injection valve 32 into the intake manifold 51 during idling of said internal combustion engine 50.

An intake air tube 31 is provided between said intake manifold 51 and an air filter (not shown) for introducing air into said intake manifold 51, a surge tank 30 is provided at lower stream side of a throttle valve 53 which is mounted in said intake air tube 31 and an flow rate control device 40 is secured on the top of said surge tank 40 with a valve housing 1 thereof fixed to the top plate of said surge tank 30. An inlet port 4 is formed on said valve housing 1 and communicated with upstream side of the throttle valve 52 of said intake tube 31 for receiving air therefrom into said valve housing 1 through a first air tube 41, a first outlet port 6 is formed on said valve housing 1 and communicated with said air chamber 52 formed in said intake manifold 51 for supplying thereto a portion of air received in said valve housing 1 through a second air tube 42 and a second outlet port 5 is formed on said valve housing 1 and communicated with the interior of said surge tank 30 for supplying thereto the remaining portion of air received in said valve housing 1.

Figure 2:
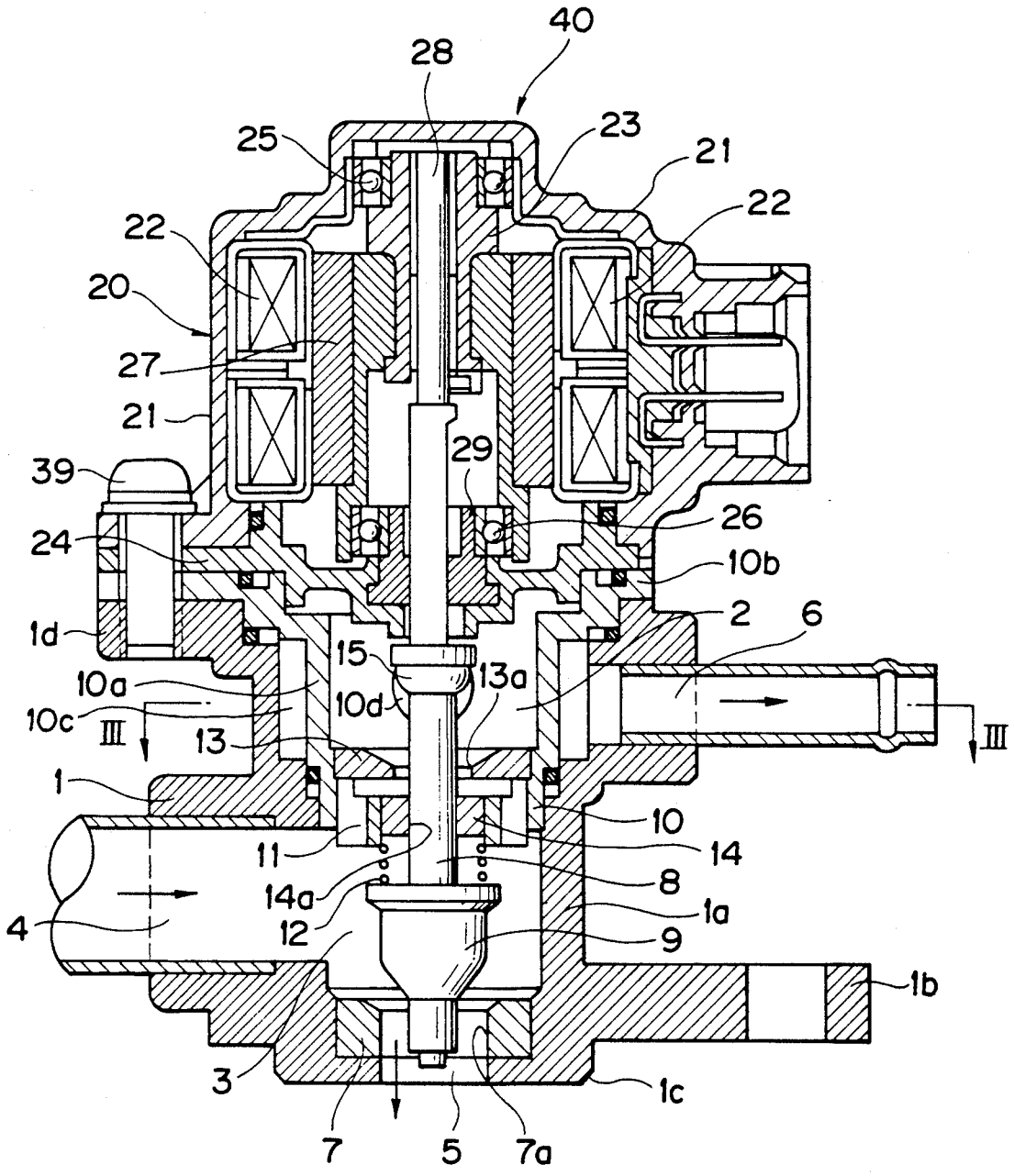
FIG. 2 is a cross sectional view of the flow rate control device of said embodiment.
Figure 3:
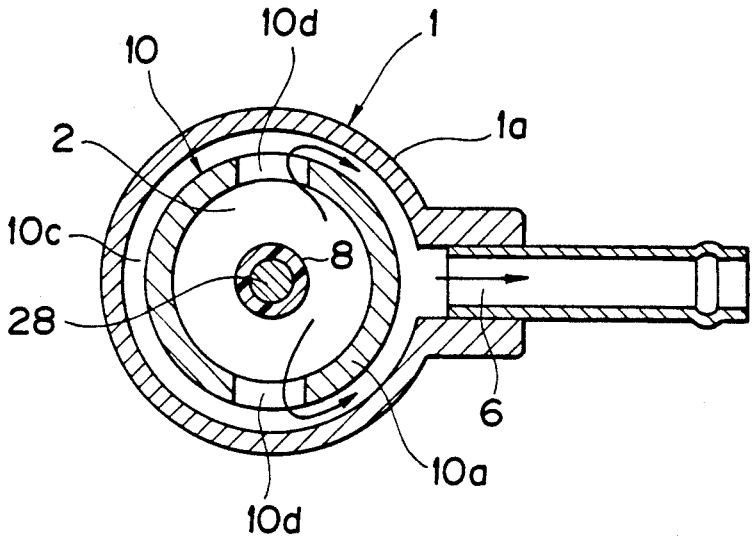
FIG. 3 is a cross sectional view of the valve housing along line III—III shown in FIG. 2, FIGS. 4 and 5 are respectively a cross sectional view of the valve body of said embodiment.

Said flow control device 40 is provided with the valve housing 1 as mentioned before. As shown in FIGS. 2 and 3, said valve housing 1 comprises a substantially tubular housing wall 1*a* of which upper axial end is opened and lower axial end is closed by an end wall 1*b* and a flange 1*c* for fixing said housing wall 1*a* to said surge tank 30 at the lower axial end of said housing wall 1*a*. Said inlet port 4 is formed on said housing wall 1*a* at a position near the end wall 1*c*, said first outlet port 6 is formed on said housing wall 1*a* at a position near the open upper axial end and said second outlet port 5 is formed on said end wall 1*c*.

In the interior space of said valve housing 1, there is provided with a valve seat retaining member 10 inserted therein from the open upper axial end thereof. The valve seat retaining member 10 comprises a tubular wall body 10*a* positioned concentrically with said housing wall 1*a* of the valve housing 1 and an annular flange 10*b* radially extending from said wall body 10*a* at the upper axial end thereof. Said flange 10*b* of the valve seat retaining member 10 is forced into contact with the open upper axial end of said housing wall 1*a* of said valve housing 1 in the axial direction and the axial length of said wall body 10*a* of the valve body retaining member 10 is made to be equal to the length between the open upper end of said housing wall 1*a* and peripheral edge of said inlet port 4 formed on said housing wall 1*a* in the axial direction of the housing wall 1*a*. An annular space 10*c* is formed between the outer peripheral surface of said tubular wall body 10*a* of the valve seat retaining member 10 and the inner peripheral surface of said tubular housing wall 1*a* of the valve housing 1. A seal ring made of elastic material is disposed between said flange 10*b* and said housing wall 1*a* and another seal ring made of an elastic material is also disposed between the lower outer peripheral surface of said wall body 10*a* and the inner peripheral surface of said housing wall 1*a* to maintain air-tightness between the wall body 10*a* and the housing wall 1*a* at upper and lower peripheral end portions of the wall body 10*a*.

A front cover 24 of a casing 21 for a stepping motor 20 and an open end portion of said casing 21 are arranged on the upper surface of the flange 10*b* of said valve seat retaining member 10, and said casing 21, said front cover 24 and said flange 10*b* of the valve seat reataining member 10 are fixed to the valve housing 1 with a bolt 39 which is screwed in a flange 1*d* of the valve housing 1 through these component members.

A rotor 23 of the stepping motor 20 is supported by bearings 25 and 26 to be freely rotatable against the casing 21 and the front cover 24 and the stator wound with the excitation coil 22 is fixed to said casing 21 to be coaxial with said rotor 23 so that the center axis of rotation of said stepping motor 20 is made coaxial with the center axis of the tubular wall body 10*a* of said valve seat retaining member 10. A permanent magnet assembly 27 having a plurality of permanent magnets coaxially aligned with each other is coaxially fixed to said rotor 23 and, when the excitation coil 22 is energized, the rotor 23 is rotated to a specified angle around the center axis of rotation of said rotor 23 in a well known manner. A shaft hole formed in said rotor 23 coaxially with the center axis of rotation of said rotor 23 is provided with an internal thread and an output shaft 28 provided with an external thread which mates said internal thread is screwed in said shaft hole. This output shaft 28 is supported with a bearing sleeve 29 provided at said front cover 24 to be freely slidable in the axial direction and to inhibit relative rotation. When said rotor 23 is rotated, said output shaft 28 moves in the axial direction of said rotor 23 as far as the distance proportional to the angle of rotation of the rotor 23 in a direction which depends on the rotational direction of the rotor 23.

Figure 4:
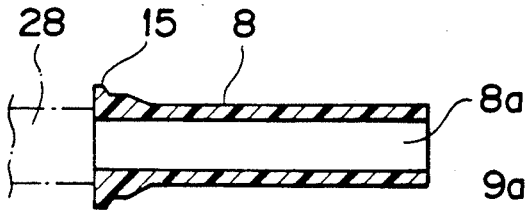
Figure 5:
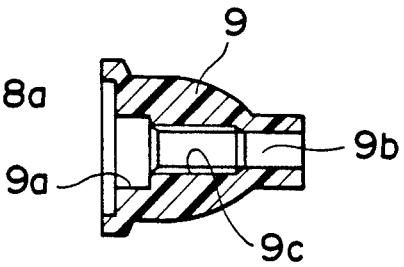

The extreme end portion of said output shaft 28 is extended on the center axis of the tubular wall body 10*a* of said valve seat retaining member 10 and first and second valve bodies 15 and 9 molded with a synthetic resin are coaxially fixed to said extreme end portion. Said first valve body 15 is molded integrally with a hollow shaft portion 8 as shown in FIG. 4 and has an axial bore 8*a* having an inside diameter, which tightly fits to the tip end portion having a smaller diameter formed at the free end portion of said output shaft 28. Said second valve body 9 is provided with an axial bore 9*a* having a larger diameter and an axial bore 9*b* having a smaller diameter formed coaxially with said axial bore 9*a*, along with the center axis of said valve body 9 as shown in FIG. 5. The inside diameter of said axial bore 9*a* has a dimension to be tightly fit to the outer tubular surface of said shaft portion 8 and the inside diameter of said axial bore 9*b* has a dimension to be tightly fit to the outer surface of the extreme end of said tip end portion having a smaller diameter than said tip end portion and screwed with a female thread 9*c* formed on the surface of said axial bore 9*c* to a male thread formed on said extreme end of the tip end portion of said output shaft 28. Said first valve body 15 is mounted on the tip end portion formed on said output shaft 28 through said axial bore 8*a*, one end portion of said valve body 15 is forced into contact with the stepped portion formed between said tip end portion and base portion of said output shaft 28 and said second valve body 9 is fitted and fixed to the extreme end of said tip end portion of said output shaft 28 with the thread 9*c* of the axial bore 9*b*.

On the inner peripheral surface of the tubular wall body 10*a* of said valve seat retaining member 10, a valve seat 13 is fixed near the free end portion (lower end portion) and a bearing 14 is fixed to the free end portion (bottom portion), respectively, with the peripheral portion thereof, and extending in parallel with each other within a plane normal to the center axis of said wall body 10*a*. A valve opening 13*a*, on which said first valve body 15 can be seated for closing, is formed in said valve seat 13 concentrically with said wall body 10*a*. Said bearing 14 is located near said inlet port 4 than said valve seat 13, and has, at its central portion, a through hole 14*a* for slidably supporting said hollow shaft portion 8 concentrically with said wall body 10*a*. On the free end portion (bottom portion) of the wall body 10*a*, a plurality of openings 11 which allow air to bypass said bearing 14 at the peripheral portion thereof are formed. A valve seat 7 is fixed to the end wall 1*c* of said valve housing 1. A valve opening 7*a*, on which said second valve body 9 can be seated thereon for closing, is formed in said valve seat 7 concentrically with said wall body 10*a* of said valve seat retaining member 10 to communicate the inlet port 4 with the interior space of said surge tank 30 through said second outlet port 5 and valve hole 7*a* of said valve seat 7.

The length of said hollow shaft portion 8 along the axial direction is determined so that, when said second valve body 9 is seated on said valve seat 7 to completely close the valve opening 7*a*, said first valve body 15 is seated on the valve seat 13, to completely close the valve opening 13*a*, simultaneously. Accordingly, when said internal combustion engine 50 is not in the state of idling, each of said first valve body 15 and second valve body 9 closes the valve opening 13*a* of the valve seat 13 and the valve opening 7*a* of the valve seat 7, respectively and simultaneously. A coil spring 12 which is profiled to extend along a conical surface is interposed between second valve body 9 and the bearing 14 and said second valve body 9 is energized by the elastic force of said coil spring 12 in a direction where said valve body 9 is seated on said valve seat 7 to ensure meshing of the external thread of said output shaft 28 and the internal thread of said rotor 23, as well as to ensure functioning to suppress axial "wobbling" of said output shaft 28.

One or a plurality of openings 10*d* are provided at the peripheral position, which is not opposed to said first outlet port 6, on the tubular wall body 10*a* of said valve seat retaining member 10 for allowing air flowing from the valve opening 13*a* of valve seat 13 to the first outlet port 6. FIG. 3 shows a cross sectional view along the line III—III shown in FIG. 2. Two openings 10*d* are provided at the positions 90 degrees away from the line drawn between the center of said output shaft 28 and the center of the first outlet port 6 in the peripheral direction of the wall body 10*a*, respectively. Accordingly, the air flow flowing from the valve opening 13*a* of said valve seat 13 to the first outlet port 6 is forced to be turned at approximately 90 degrees when the air flow flows from the openings 10*d* into the annular space 10*c*.

In the above embodiment, when said internal combustion engine 50 is not in the condition of idling, the first and second valve bodies 15 and 9 close the valve openings 13*a* and 7*a* of valve seats 13 and 7, respectively. When the internal combustion engine 50 is idling, a signal representing the operating condition of said internal combustion engine 50 as a parameter, for example a direct current signal based on a temperature of coolant, is applied to said stepping motor. Said stepping motor 20 moves the output shaft 28 in the axial direction in accordance with the direction and magnitude of the direct current applied and controls the air flow which passes through valve openings 13*a* and 7*a* of valve seats 13 and 7.

When said internal combustion engine 50 is in the condition of idling, the throttle valve 53 provided in said intake air tube 31 is almost completely closed and therefore the air pressure in the intake manifold 51 of said internal combustion engine 50 remarkably reduces. In this case, the air in the air passage at the upper stream side of the throttle valve 53 of intake air tube 31 is sucked into the inlet port 4 of the valve housing 1 of said flow control device 40 through the air passage formed inside said first air pipe 41 and flows into the first flowing space 3 formed between said inlet port 4 and said valve seat 13 and further into the second flowing space 2 formed between said valve seat 13 and said first outlet port 6, thus producing two air flows, that is, an air flow which flows from said second outlet port 5 to the intake manifold 51 and another air flow which is injected from the injection port 33 of the air chamber 52 formed in said intake manifold 51. The latter air flow, which has passed through the valve opening 13*a* of said valve seat 13, passes through the long flow passage from the inside of the wall body 10*a* of the valve seat retaining member 10 to said first outlet port 6 through the opening 10*d* formed in said wall body 10*a* to the annular space 10*c* in said second flowing space 2 and the direction of this air flow is turned by approximately 90 degrees when the air passes through said opening 10*d* formed in said wall body 10*a*. Dust, oil mist and mixture of these matters contained the air flow in said flowing space 2 deposit on the inner peripheral surface of housing wall 1*a* of said valve housing 1 and the inner and outer peripheral surfaces of wall body 10*a* of said valve seat retaining member 10 when said air flow changes its flowing direction and flows in the folded passage. Dust and oil mist contained in the air flow which may be supplied to said air chamber 52 and injected from the injection port 33, are removed during flowing through said flowing space 2 and will not clog said injection port 33.

Said valve housing 1 can be removed from the valve seat retaining member 10 by removing the bolt 39 and the valve seat retaining member 10 can also be removed from the casing 21 of stepping motor 20 by removing said second valve body 9 from said output shaft 28 and therefore the dust and oil mist deposited in the valve housing 1 and the valve seat retaining member 10 can be extremely easily removed.

Figure 6:
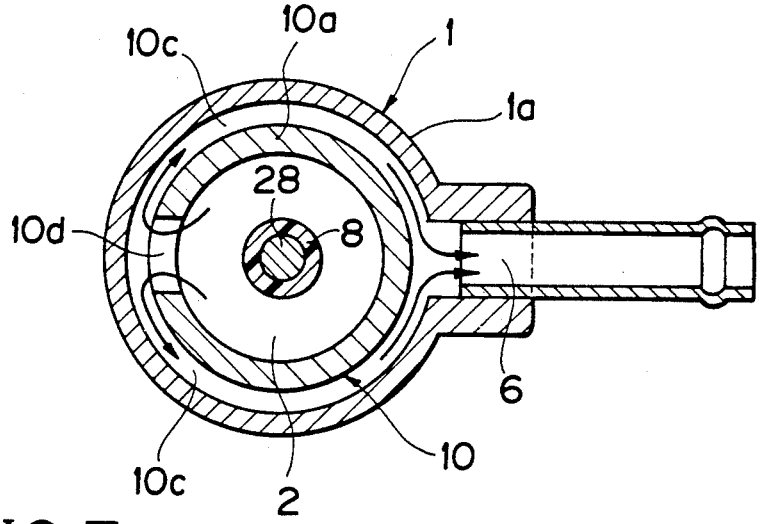
FIGS. 6 to 8 are respectively a cross sectional view of the valve housing in another embodiment of the present invention.
Figure 7:
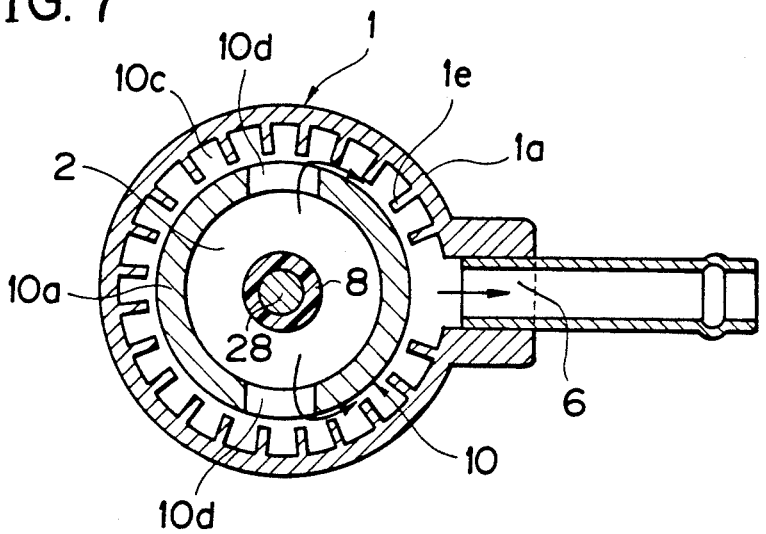
Figure 8:
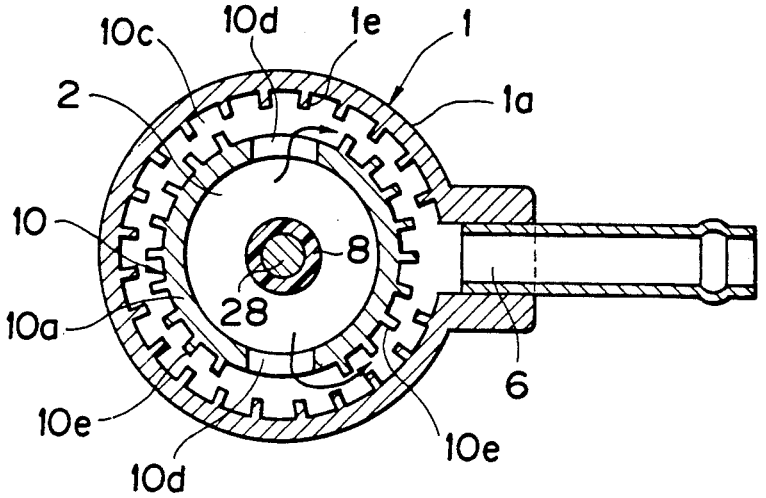

FIGS. 6 to 8, showing other embodiments in accordance with the present invention, respectively, show the position of the opening 10*d* formed in said valve seat holding member 10 and the surface profiles of the housing 1*a* of said valve housing 1 and the wall body 10*a* of said valve seat retaining member 10 in the cross sectional view along the line III—III shown in FIG. 2, as different embodiments.

In the embodiment shown in FIG. 6, the opening 10*d* formed in the wall body 10*a* of valve seat retaining member 10 is provided at a position 180 degrees away from the line drawn between the center of said output shaft 28 and the center of said first outlet port 6 in the circumferential direction of the wall body 10*a*. Accordingly, the air flow which enters the valve opening 13*a* of said valve seat 13 into the flowing space 2 flows into said first outlet port 6 through the space 10*c* as long as approximately a half of the circumference of said wall body 10*a* after having passed through said opening 10*d*.

In the embodiment shown in FIG. 7, a number of fins 1*e* are provided as protruded on the inner periphery of the housing wall 1*a* of said valve housing 1 which faces said space 10*c*. In the embodiment shown in FIG. 8, a number of fins 1*e* are provided as protruded on said housing wall 1*a* and a number of fins 10*e* are provided as protruded on the inner periphery of the wall body 10*a* of said valve seat retaining member 10 which faces said space 10*c*.

As described referring to the embodiment shown in FIGS. 6 to 8, almost all of dust and oil mist contained in the air flow can be removed in the flowing space 2 by providing a long passage where the air flowing into the flowing space 2 reaches said first outlet port 6 or a large area with which the air comes in contact on the wall of said air flow passage.

What is claimed is:

1. An apparatus for controlling an idling revolution speed of an internal combustion engine, including a valve housing having one inlet port and at least one outlet port, a valve seat disposed between said inlet port and said outlet port in said valve housing, an actuator attached to said valve housing, a valve body driven by said actuator to relatively move in reference to an opening formed in said valve seat as far as a distance in response to a signal applied to said actuator, an air passage for communicating said inlet port of said valve housing with an intake passage of an internal combustion engine at an upstream side passage of a throttle valve provided therein, and an air passage for communicating said outlet port with an injection port opening near a fuel injection valve installed on an intake manifold of said internal combustion engine, characterized in that:

an annular valve seat retaining member is detachably fixed to said valve housing and to be air-tight at peripheral edge portions thereof for forming a space located between said member and said housing wall having said outlet port and communicating with said outlet port, said valve seat is fixed at the outer periphery thereof to an inside wall of said annular valve seat retaining member air-tightly, and said valve seat retaining member is provided with an opening for communicating said outlet port with said opening of said valve seat through said space at a position which is not opposed to said outlet port in a circumferential direction of said valve seat retaining member.

2. An apparatus for controlling an idling revolution speed of an internal combustion engine in accordance with claim 1, wherein said housing wall is formed, substantially cylindrically and said valve seat retaining member has a substantially cylindrical wall body and is air-tightly contracted at both axial edge portions thereof with said housing wall.

3. An apparatus for controlling an idling revolution speed of an internal combustion engine in accordance with claim 2, wherein a number of protrusions are provided on one of the outer peripheral surface of said valve seat retaining member and the inner peripheral surface of said housing wall located at positions opposing to each other to increase the total area of these surfaces.

4. An apparatus for controlling an idling revolution speed of an internal combustion engine in accordance with claim 2, wherein a number of protrusions are provided on the outer peripheral surface of said valve seat retaining member and the inner peripheral surface of said housing wall located at positions opposing to each other to increase the total area of these surfaces.

5. An apparatus for controlling an idling revolution speed of an internal combustion engine in accordance with claim 2, wherein said actuator is a stepping motor having a center axis of rotation coaxial with the center axis of the tubular wall body of said valve seat retaining member and said valve body is mounted on a valve shaft which is driven by said stepping motor and moved in the axial direction along said center axis of rotation.

6. An apparatus for controlling an idling revolution speed of an internal combustion engine in accordance with claim 5, wherein said valve seat retaining member is provided with a flange protruding in radial direction thereof, at an axial edge portion of said cylindrical wall body and detachably fixed to said valve housing and the casing of said stepping motor.

7. An apparatus for controlling an idling revolution speed of an internal combustion engine in accordance with claim 5, wherein said valve housing is provided with a second outlet port at an axial end thereof, a second valve seat is disposed between said inlet port and said second outlet port and a second valve body is mounted on an extreme end portion of said valve shaft to be relatively moved in reference to an opening formed on said second valve seat for controlling air flow discharged from said second outlet port into said intake air passage at the downstream side passage of said throttle valve.

* * * * *